United States Patent [19]

Frisbee

[11] 4,111,268

[45] Sep. 5, 1978

[54] SCRAPER BLADE CONTROL

[75] Inventor: Claude M. Frisbee, Bettendorf, Iowa

[73] Assignee: J. I. Case Company, Racine, Wis.

[21] Appl. No.: 806,246

[22] Filed: Jun. 13, 1977

Related U.S. Application Data

[63] Continuation-in-part of Ser. No. 680,817, Apr. 28, 1976, Pat. No. 4,074,769.

[51] Int. Cl.[2] ..... E02F 3/76

[52] U.S. Cl. ..... 172/805

[58] Field of Search ..... 172/801, 803–809

[56] References Cited

U.S. PATENT DOCUMENTS

| | | | |
|---|---|---|---|
| 2,678,508 | 5/1954 | Reuter | 172/807 |
| 2,943,407 | 7/1960 | Frisbee | 172/804 |
| 3,645,340 | 2/1972 | Frisbee | 172/805 |
| 3,777,824 | 12/1973 | Anderson | 172/801 |
| 4,074,769 | 3/1978 | Frisbee | 172/804 |

*Primary Examiner*—Richard J. Johnson

*Attorney, Agent, or Firm*—Cullen, Sloman, Cantor, Grauer, Scott & Rutherford

[57] ABSTRACT

A blade control for a vehicle having a transverse scraper blade supported on the forward end for relative movement. The control includes a plurality of hydraulic piston-cylinders interconnected between the vehicle and the blade for adjusting the relative position of the blade. A plurality of flexible fluid lines extend from the lower forward end of the vehicle to the rear of the blade in a downwardly opening arch. The lines then extend across the rear of the blade to the piston-cylinders to extend and retract the cylinders. The disclosed control includes a support means protecting, supporting and separating the lines including a flexible sheet operably connected adjacent its lower end to the vehicle, beneath the upwardly extending arch of control lines, supporting and protecting the lines and a clamp adjacent the upper free end of the sheet separating the lines and preventing tangling during operation of the blade.

8 Claims, 7 Drawing Figures

FIG. 1
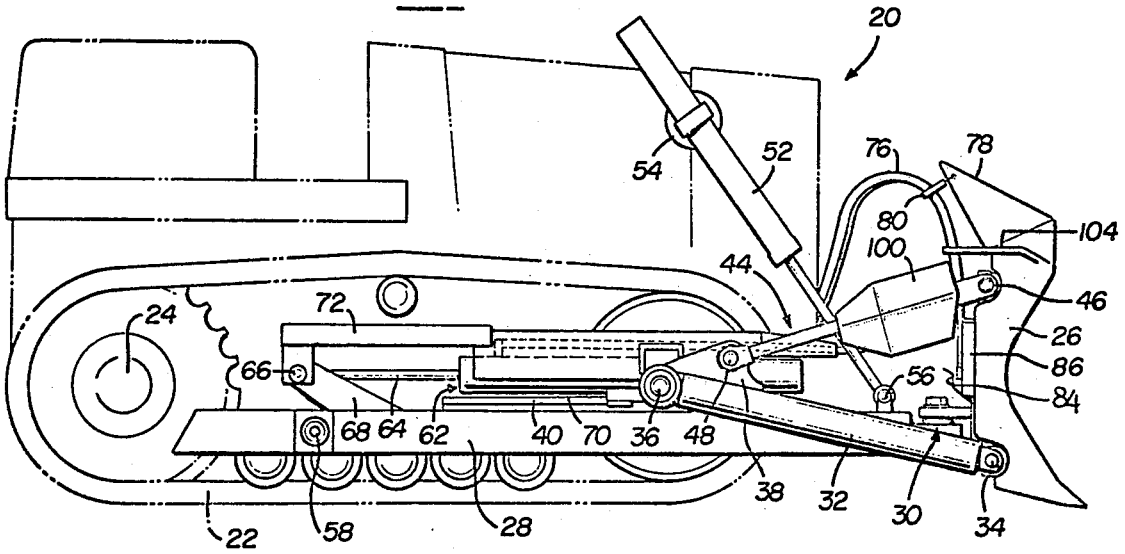
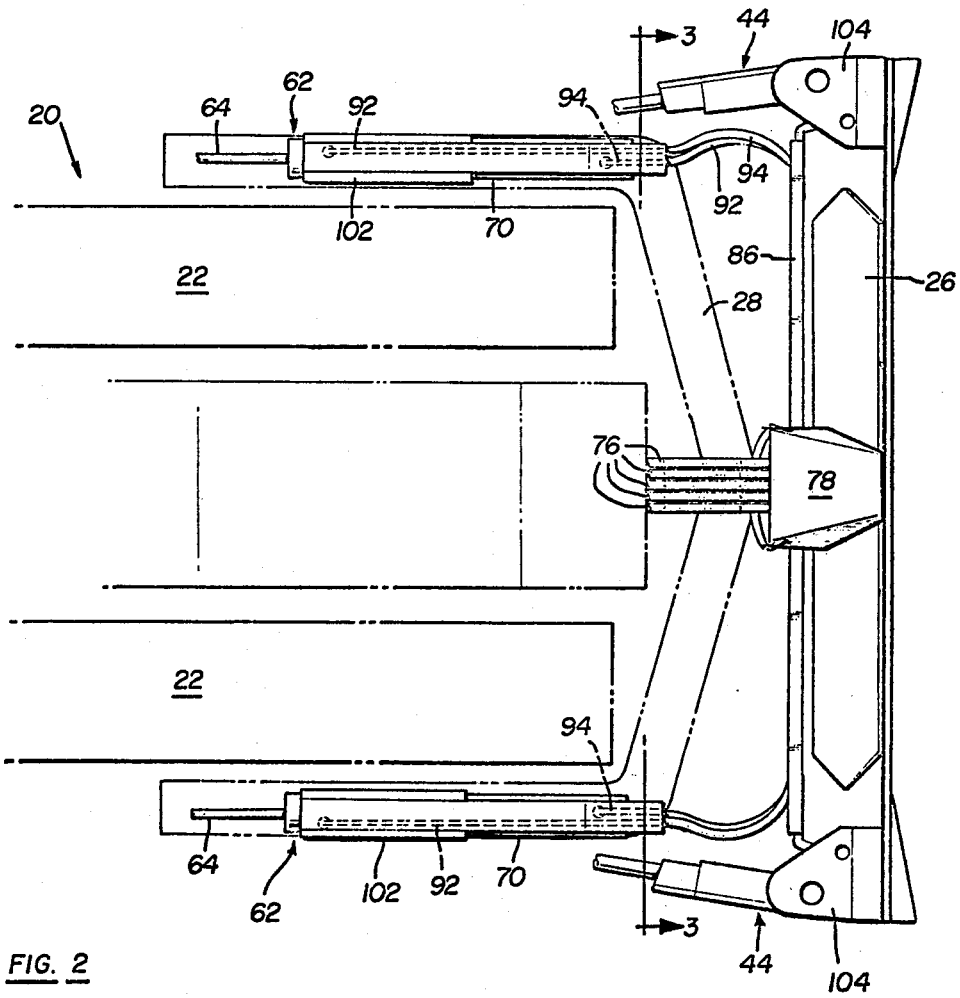
FIG. 2

FIG. 7
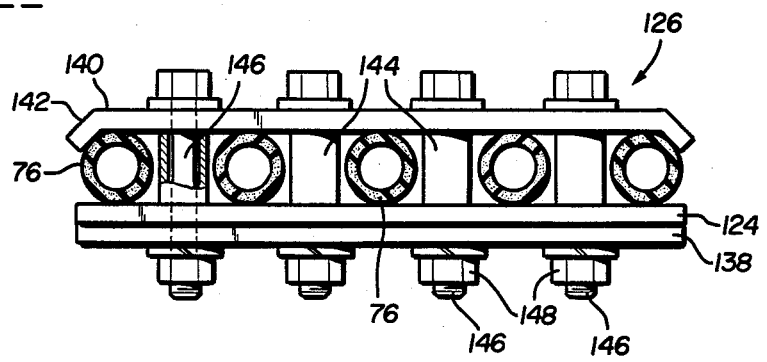
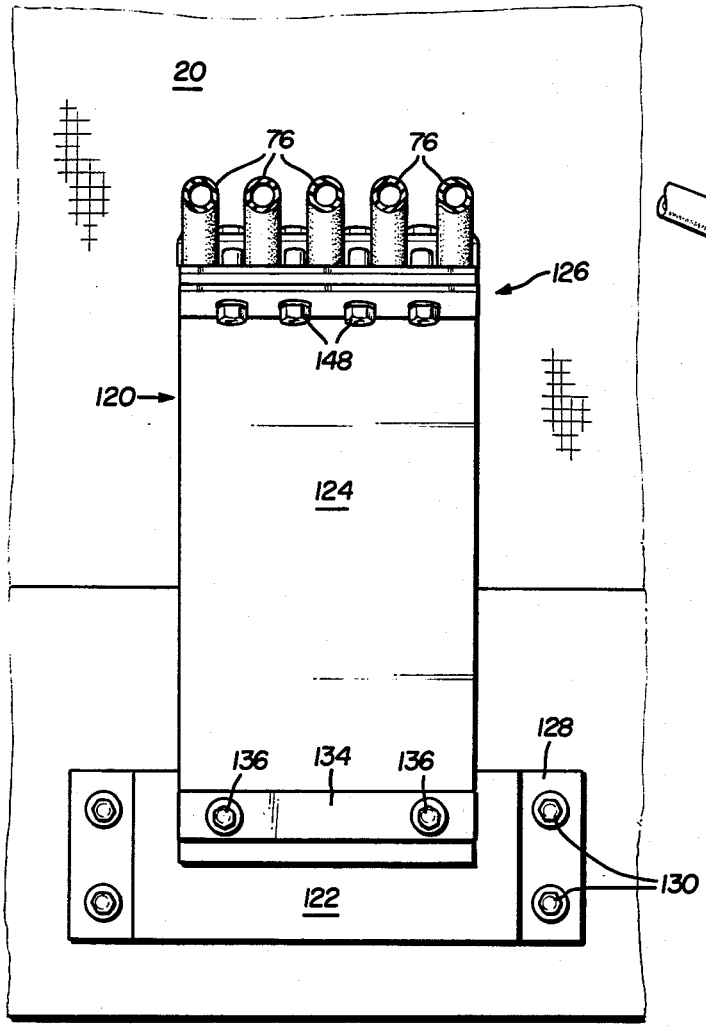
FIG. 5
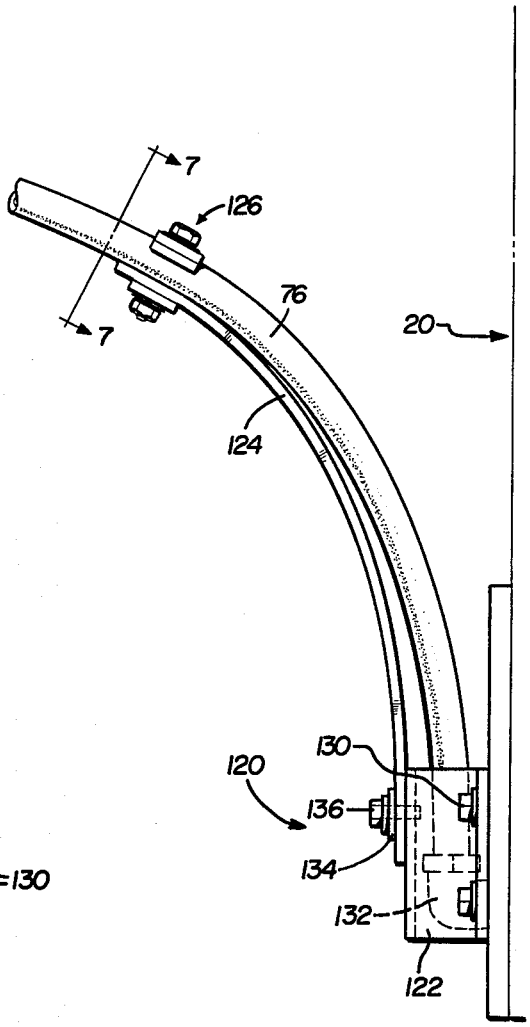
FIG. 6

SCRAPER BLADE CONTROL

RELATED TO THE APPLICATION

This application is a Continuation-in-Part application of my copending application for United States patent, Ser. No. 680,817, filed Apr. 28, 1976, now U.S. Pat. No. 4,074,769.

FIELD OF THE INVENTION

The present invention relates to bulldozers, tractors and the like having transversely extending scraper blades and more particularly to hydraulic control means for adjusting the position of the blade, particularly about a vertical axis, commonly referred to as angling.

A modern bulldozer blade may be hydraulically angled, tilted, pitched, raised and lowered to adjust the blade in any desired position. The blade is preferably supported on a U or C-shaped frame which is pivotally connected adjacent its ends to the sides of the bulldozer as shown in U.S. Pat. No. 2,943,407, assigned to the assignee of the instant application. The blade is supported adjacent its midportion to the center of the frame and the opposed sides are connected to hydraulic cylinders for angling, pitching, or tilting of the blade. Where the control includes all three functions, the blade is supported on a ball joint such as shown in my U.S. Pat. No. 3,645,340.

The blade is angled by piston-cylinders along the sides of the bulldozer connected at one end to the frame and operably connected at the opposed end to the sides of the bulldozer blade. One angle cylinder is extended while the opposed cylinder is retracted to adjust the blade about a vertical axis.

At present, there are two types of angling cylinders, including the solid rod end mounted cylinders shown in the above referenced U.S. Pat. No. 2,943,407 and hollow rod-trunnion mounted cylinders as shown in my above referenced patent. In the solid rod angle cylinders, the hydraulic cylinders are pivotally connected to the bulldozer and the rods extend forwardly to angle the bulldozer blade. The hydraulic lines extend out of the side of the bulldozer and are connected to the hydraulic cylinders. In the hollow rod-trunnion mounted angle cylinders, the rod end of each angle cylinder is pivotally connected to the bulldozer and the cylinder portion is extensible forwardly to angle the blade. The hydraulic control is then connected to the hollow piston rods to actuate the piston-cylinders. The hollow rod-trunnion mounted angle cylinders are presently preferred because of the simplicity of the hydraulic control and for the reasons set forth in my above referenced patent. The disadvantages of the hollow rod-trunnion mounted cylinders are cost and maintenance. The relatively long hollow piston rod is substantially more expensive than a more conventional solid piston rod. The disadvantages of the present solid rod, end mounted angle cylinders are (1) a limited degree of angle or angle stroke, and (2) a low column strength at maximum angle, i.e. full extension of one piston rod.

The improved bulldozer blade control of the present invention permits the utilization of a solid rod piston-cylinder without the disadvantages of the present rod end mounted cylinders by extending the hydraulic control lines from the front of the bulldozer to the angle cylinders. The flexible lines are protected and supported by guards extending across the bulldozer blade from side to side and at the front of the bulldozer as more fully described hereinbelow.

SUMMARY OF THE INVENTION

The vehicle blade control of the present invention may be utilized in a conventional bulldozer, tractor or the like having a side mounted frame, such as the U-shaped frame disclosed in the above referenced patents. The blade may be mounted on the frame for angling, tilting, pitching, raising and lowering. The angling control includes a piston-cylinder on opposed sides of the bulldozer, each piston-cylinder having a rearwardly extending piston rod operably connected to the dozer and a forwardly extensible cylinder operably connected to the sides of the dozer blade. The angle cylinder arrangement is therefore similar to the hollow rod-trunnion mounted cylinders disclosed in my above referenced United States Patent, providing the advantages of this arrangement. The control means disclosed herein however eliminates the requirement of hollow piston rods, thereby eliminating the primary disadvantages.

The hydraulic control of the present invention includes flexible hydraulic lines which extend from the front of the dozer to the back of the scraper blade, then in opposite directions along the back of the blade to the adjacent side edges of the blade. Finally, depending on the control, the hydraulic lines extend rearwardly, preferably along the side frames to the angle control cylinders. In the preferred embodiment, the blade includes a channel-shaped shroud or guard extending across the blades from side to side. In the disclosed embodiment, the shroud includes the connections which distribute the hydraulic fluid lines to extend one angle cylinder forwardly while simultaneously retracting the opposed cylinders.

As stated, in the preferred embodiment of the blade control, the blade may be angled, tilted, pitched, raised and lowered, requiring a plurality of lines which may become tangled or damaged during adjustment of the blade. The disclosed embodiment includes five lines. Thus, the hydraulic control lines must permit free movement of the blade and the lines must be protected against accidental damage. In the preferred embodiment of the blade control, a guard-support is used having a flexible sheet connected adjacent its lower end to the vehicle, beneath the upwardly extending arch of control lines. The sheet extends upwardly from its connection to the vehicle, beneath the lines, to support the upwardly extending arch and protect the lines. In the preferred embodiment, the sheet is formed of a material which will both support and protect the lines, such as a rubberized cotton duck used in conveyor belting. The upper free end of the sheet is preferrably clamped to the lines and includes retainers located between the lines. In the disclosed embodiment, the clamp includes clamping plates on opposed sides of the lines and a plurality of spacers extending between the lines preventing tangling of the lines during operation of the blade and holding the clamp plates.

Other advantages and meritorious features of the bulldozer blade control of the present invention will be more fully understood from the following description of the preferred embodiments, the appended claims and the drawings, a brief description which follows.

BRIEF DESCRIPTION OF THE DRAWINGS

FIG. 1 is a side elevation of a conventional bulldozer having the improved blade control of this invention;

FIG. 2 is a partial top view of the bulldozer shown in FIG. 1;

FIG. 5 is a front view of the protector-support for the control lines in the preferred embodiment of this invention;

FIG. 6 is a side view of the protector-support shown in FIG. 5; and

FIG. 7 is a cross sectional view of the control lines with the protector-support partially cross sectioned in the direction of view arrows 7—7 in FIG. 6.

DESCRIPTION OF THE PREFERRED EMBODIMENTS

Figure 3:
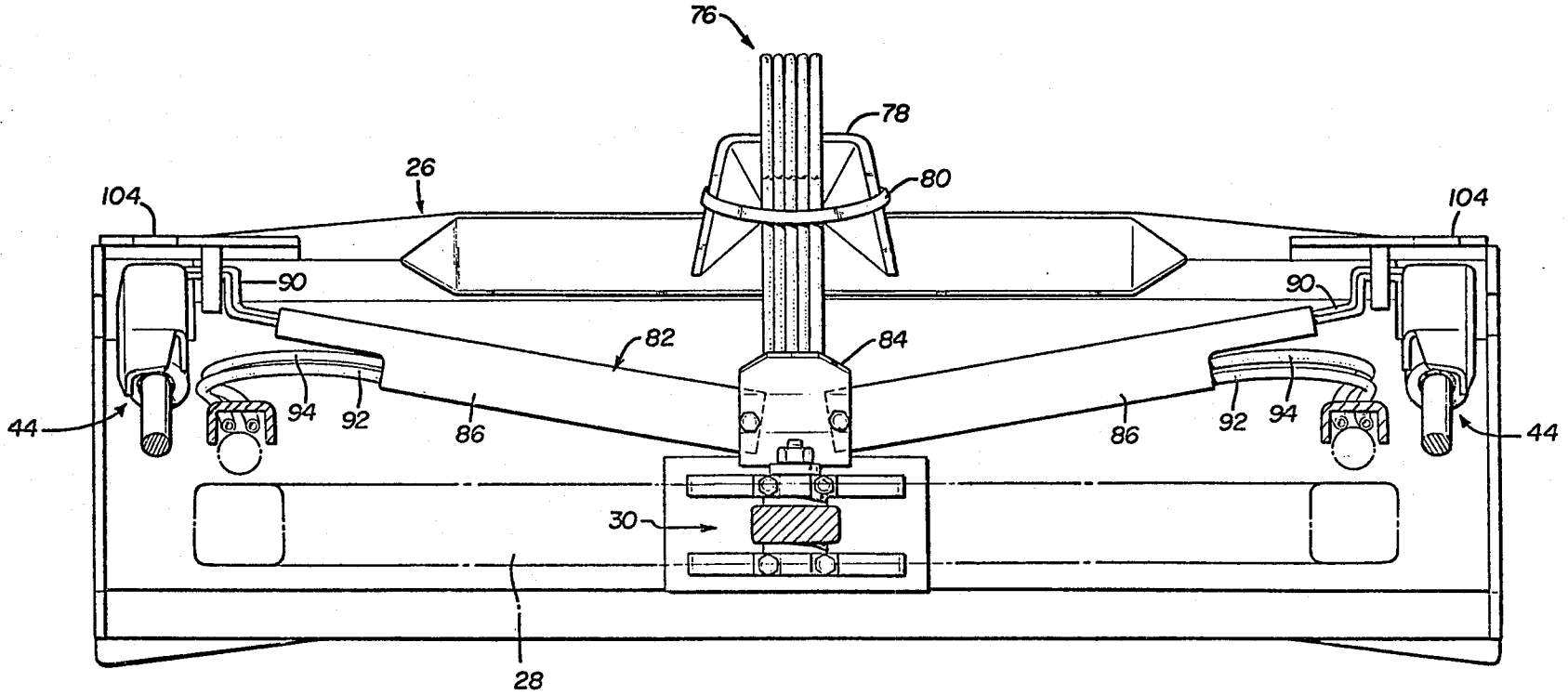
FIG. 3 is an end view of the bulldozer blade shown in FIG. 2, in the direction of view arrows 3—3.

A crawler tractor or bulldozer 20 having one embodiment of the bulldozer blade control of the present invention is shown in FIGS. 1 and 2. It will be understood however that the blade control of the present invention may be utilized in other implements having the prior art problems described hereinabove. For example, the blade control of the present invention may be utilized in a wheeled vehicle or tractor. The following description will however be limited to a bulldozer of the type shown for simplicity of illustration and because the blade control of the present invention is particularly suitable for a bulldozer of the type shown.

The disclosed bulldozer includes continuous tracks 22 on opposed sides of the bulldozer which are supported on transverse axles 24. The bulldozer includes a conventional transverse scraper blade 26 which is supported on a C or U-shaped frame assembly 28. The midportion of the blade is preferrably supported on the frame by a ball joint assembly 30 as more fully described in my above referenced United States Patent.

The lower edge of the blade is supported by struts 32 which are connected to the lower side corners of the blade by universal joints 34. The rearward ends of struts 32 are pivotally connected at 36 to slides 38. The slides in turn, are slidably secured to the frame assembly on slide tracks 40. The upper corners of the blade are connected to slides 38 by tilt-pitch cylinders 44. The tilt-pitch cylinders are connected to the upper corners of the blade by universal joints 46 and the rearward ends of cylinders 44 are connected to slide brackets 38 by pivotal connections 48.

Thus, in the disclosed embodiment of the bulldozer blade control, the blade 26 may be pitched about the horizontal axis of the ball joint 30 by simultaneously extending the opposed tilt-pitch cylinders 44. The blade may be tilted about the longitudinal axis of the bulldozer by extending one tilt-pitch cylinder 44 and retracting the opposed piston-cylinders. The blade in the disclosed embodiment may also be raised and lowered by lift piston-cylinders 52. The cylinders 52 are pivotally secured to the sides of the bulldozer by trunnion mountings 54. The piston rods of the lift cylinders are connected to the bulldozer frame by trunnion connections 56. The opposed ends of the C or U-shaped frame are pivotally connected to the sides of the bulldozer by pivotal connections 58. The blade may thus be raised by simultaneously retracting the lift cylinders 52, wherein the frame and the supported blade are raised by pivoting the frame and the supported blade 26 about frame axis 58.

The blade of the disclosed embodiment of the bulldozer may thus be tilted or pitched by operation of piston-cylinders 44, raised or lowered by operation of piston-cylinders 52 and angled as described below about the vertical axis of the center ball joint 30. It will be understood however that the control of the present invention may also be used in an angle-tilt bulldozer such as disclosed in the above referenced U.S. Pat. No. 2,943,407 or a more simple angle bulldozer. Details of the control mechanism and structure necessary for pitching, tilting, raising and lowering the bulldozer blade may be found in my above referenced U.S. Pat. No. 3,645,340.

As described, the angle cylinder arrangement may be generally similar to the angle control disclosed in my above referenced U.S. Pat. No. 3,645,340. The angle cylinders 62 each include a piston rod 64 pivotally connected at 66 to a bracket 68 connected to the frame 28. The cylinder portion 70 is pivotally connected to slide 38 and therefore operably connected to the sides of the bulldozer blade 26 to angle the blade about the vertical axis of ball joint 30. A cover guard 72 is pivotally connected at 66 to bracket 68 which protects the angle cylinders from accidental damage. Angling is accomplished by extending one cylinder 70 and retracting the opposed slide to move the blade about the vertical axis of ball joint 30.

In the angle cylinder arrangement disclosed in my above referenced United States Patent, the piston rods are hollow and the hydraulic lines extend out of the bulldozer at the rear of the push trunnion and are connected to the hollow piston rods. The piston rods of the angle control must be able to withstand the force of plowing at any angled position, requiring great axial and torsion strength. The hollow piston rods are therefore very expensive. The improved blade control of this invention permits the use of solid piston rods, which substantially reduces the cost of the angle cylinders while retaining the advantages of forwardly extensible cylinders described above. Further, the rear hydraulic control lines of the hollow rod-trunnion mounted cylinders were subject to damage, which has been eliminated by the forward hydraulic control lines utilized in the present invention.

Figure 4:
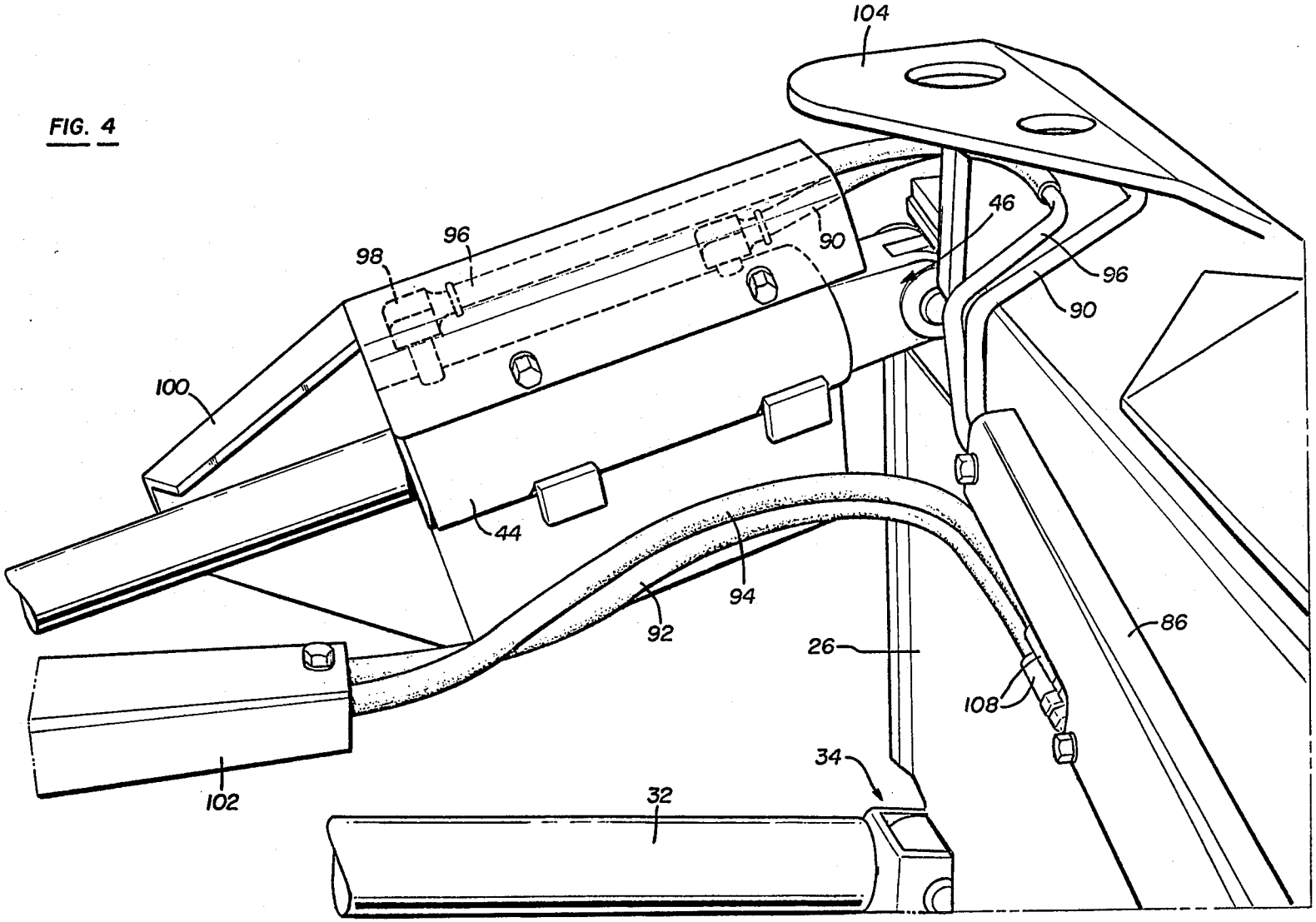
FIG. 4 is a top perspective view of a tilt-pitch cylinder with the related control lines.

As shown in FIG. 1, the hydraulic control lines 76 extend in an arch from the lower forward end of the bulldozer to the back of the bulldozer blade 26. A cowl or guide 78 is provided on the top of the bulldozer blade having a guide strap 80 receiving the control lines. The control lines then extend downwardly along the back of the bulldozer blade to a guard or shroud 82 which extends longitudinally along the back of the blade from side to side. The shroud 82 includes a center cover or access plate 84 and a pair of oppositely extending channel-shaped guard elements 86. As shown, there are five hydraulic control lines 76 for an angle, tilt, pitch bulldozer of the type shown. Two of the lines 90 extend directly from the bulldozer to the forward or head end of the tilt-pitch cylinders 44. The remaining three lines are divided by T-couplings behind access plate 84 as follows. Lines 92 are connected to the rod ends of angle cylinders 70, lines 94 are connected to the head ends of angle cylinders 70, and lines 96 are connected to the rod ends of tilt-pitch cylinders 44 as shown in FIG. 4. The plumbing, including valves, pump, etc. may be generally similar to the angle, tilt-pitch control disclosed in my above referenced U.S. Pat. No. 3,645,340.

The lines 90 to 96 may be connected to cylinders 44 and 70 by conventional connectors, such as shown at 98 in FIG. 4. Guards 100 are attached to tilt-pitch cylinders 44 by welding or other suitable means, as shown in FIGS. 1 and 4, to protect the piston-cylinders and the control lines 90 and 96. Channel-guards 102 protect angle cylinders 70 and control lines 92 and 94 as shown in FIGS. 2 and 4. Guard plates 104 are connected to the top outer edges of blade 26 to protect lines 90 and 96.

Lines 76 are flexible hydraulic lines and extend in an arch from the bulldozer to the back of the bulldozer blade to permit raising and lowering of the bulldozer blade as described above. Flexible hydraulic lines are available commercially from various sources and are generally formed from reinforced polyurethane, polytetroflouroethylene or synthetic rubbers. Lines 92 and 94 include a slack portion between the back of the bulldozer blade and channel guard 102 as shown in FIGS. 2 and 4 to permit the blade to be angled, tilted and pitched. The lines, where flexibility is not required may be formed of metal pipe. For example, couplings are provided as shown in FIG. 4 between the flexible hydraulic lines and the metal pipes. The angle cylinder 70 may therefore be extended or retracted while coupled by flexible lines 92 and 94 to the hydraulic control, with the slack portion being protected between the blade 26 and the guard or shield 100.

FIGS. 5 to 7 illustrate a guard or protector-support utilized in the preferred embodiment of the blade control. In the preferred embodiment, the guard-support assembly 120 includes a guard bracket 122, a flexible guard-support sheet 124 and a clamp assembly 126. The guard bracket is channel-shaped having outwardly projecting end portions 128 which are bolted to the forward end of the tractor 20 by bolts 130. As shown in FIG. 6, the midportion of the channel-shaped bracket encloses the lines as they extend from the tractor. In the disclosed embodiment, L-shaped fittings 132 extend from the tractor and the lines 76 are connected to the fittings.

The flexible guard-support sheet 124 is secured to the midportion of the bracket 122 by plate 134 and bolts 136. The free end of the flexible sheet 124 is secured to the hydraulic lines 76 by bracket 126. In the preferred embodiment, the bracket 126 separates the lines 76 and prevents the lines from being tangled during operation of the blade. The bracket in the disclosed embodiment includes opposed bracket plates 138 and 140. Bracket plate 140 in the disclosed embodiment is generally C-shaped having retainer end-portions 142 retaining the end hydraulic lines. The adjacent hydraulic lines are separated by tubular spaces 144 which engage the opposed plates 138 and 140. Bolts 146 extend through each of the spacers, which are secured by nuts 148. The disclosed embodiment also includes washers between the head of the bolts 146 and the plate 140 and between the plate 138 and the nuts 148. The nuts 148 are tightened to securely clamp the free end of the flexible sheet 124 to the hydraulic lines and retain the spacers 144 between adjacent hydraulic lines.

In the preferred embodiment of the guard-support assembly, the flexible sheet 124 is self-supporting to support the upwardly extending arch shown in FIG. 1 as best shown in FIG. 6. The flexible sheet also protects the underside of the hydraulic lines from stones and other debris which may be thrown up by the track or the plow blade. A very suitable material is a rubberized cotton duck as is utilized for conveyor belting. A suitable material is two ply, 28 ounce rubberized cotton duck, ¼ inch thick. The belting is sufficiently flexible to permit uninhibited use of the plow blade while supporting and protecting the hydraulic fluid lines. As shown, one end is fixed to bracket 122 by plate 134 and the opposed end is free and connected to the hydraulic lines by clamp assembly 126. The clamp assembly also separates the hydraulic lines and prevents twisting of the lines during adjustment of the blade.

The hydraulic control thus eliminates the requirement for hollow rod-trunnion mounted angle cylinders, while retaining the advantages and simplifying the hydraulic circuitry. The bulldozer blade may be raised and lowered by lift piston-cylinders 52 without interfering with the hydraulic control lines 76 and the blade may be angled, tilted and pitched without twisting or interfering with the hydraulic control lines. The guard-support assembly 120 protects the hydraulic control lines from damage and supports the upwardly extending arch of control lines which are received in the guide 78 on the top of the bulldozer blade. Having described the improved scraper blade control of this invention and its operation in detail,

What is claimed is:

1. A blade control for a vehicle having a transverse blade supported on the forward end of said vehicle for movement of the blade relative to the vehicle, said control including a plurality of hydraulic piston-cylinders interconnected between said vehicle and said blade for adjusting the relative position of said blade, a plurality of flexible hydraulic fluid lines extending from the lower forward end of said vehicle in an upwardly extending arch to the rear of said blade in a downwardly extending arch, said lines then extending across the rear of said blade to said piston-cylinders and a flexible guard-support means protecting, supporting and separating said lines, comprising a flexible sheet operably connected adjacent its lower end to said vehicle beneath said upwardly extending arch of said flexible hydraulic fluid lines, said sheet extending upwardly beneath said lines, supporting and protecting said arch and a clamp adjacent the free upper end of said sheet including a clamp on opposed sides of said lines and retainers located between said lines interconnecting said clamps, said retainers separating said lines and preventing tangling during operation of said blade.

2. The vehicle blade control defined in claim 1, characterized in that said flexible sheet is formed from a reinforced sheet of rubber, providing protection for the lower surface of said flexible hydraulic fluid lines adjacent the forward end of said vehicle.

3. The vehicle blade control defined in claim 1, characterized in that said lines are connected to L-shaped connectors extending from the lower forward end of said vehicle, a U-shaped bracket connected to the forward end of said vehicle at opposed ends having a midportion partially enclosing the forward end of said L-shaped connectors and the lower end of said flexible sheet connected to said bracket.

4. The vehicle blade control defined in claim 3, characterized in that said flexible support clamp means includes a retainer located between adjacent lines separating said lines and preventing tangling of said lines during operation of said blade.

5. The vehicle blade control defined in claim 3, characterized in that a U-shaped bracket is connected to the forward end of said vehicle at opposed ends, the midportion of said connector enclosing the lines as they extend from said vehicle and the lower end of said flexible sheet connected to said bracket.

6. The vehicle blade control defined in claim 3, characterized in that said flexible sheet is formed from a heavy rubberized fabric, said sheet protecting the lower forward ends of said flexible lines adjacent said vehicle.

7. A blade control for a vehicle having a generally U-shaped frame extending around the forward end of said vehicle in spaced relation, a transverse blade mounted adjacent its midportion on the forward end of said frame for pivotal angling movement about a vertical axis, an angling piston-cylinder on each side of said vehicle, each piston-cylinder having a fluid cylinder operably connected to one side of said blade and a rearwardly extensible piston rod operably connected to said vehicle and a fluid control, comprising a plurality of flexible hydraulic fluid lines extending from the lower forward end of said vehicle upwardly in a downwardly opening arch to the rear of said blade, said lines extending across the rear of said blade to adjacent the opposed side edges of said blade, said lines then extending rearwardly to said fluid cylinders of said angling piston-cylinders and a flexible guard-support for the upwardly extending arch of said fluid lines, comprising a flexible sheet attached adjacent its lower end to said vehicle beneath said arch, said sheet flexibly supporting and protecting the upwardly extending portion of said lines and the upper free portion of said flexible sheet attached to said lines by a clamp means.

8. The vehicle blade control defined in claim 7, characterized in that said clamp means comprises transverse clamp plates on opposed sides of said lines and a plurality of bolts located between adjacent lines compressing said plates against said lines and preventing tangling of said lines during angling of said blade by said piston-cylinders.

* * * * *